United States Patent [19]

White

[11] 4,179,973

[45] Dec. 25, 1979

[54] MUSICAL SHAKER

[75] Inventor: Wesley C. White, San Diego, Calif.

[73] Assignee: Partee Products, San Diego, Calif.

[21] Appl. No.: 876,569

[22] Filed: Feb. 10, 1978

[51] Int. Cl.[2] ..... G10D 13/06

[52] U.S. Cl. ..... 84/402; D17/22; 46/193; D21/65

[58] Field of Search ..... 84/402, 411 R; 46/193; D34/15 AG; D56/1 E; D17/22–23

[56] References Cited

U.S. PATENT DOCUMENTS

| | | | |
|---|---|---|---|
| D. 174,198 | 3/1955 | Shane | D34/15 AG |
| 2,289,314 | 7/1942 | Davis | 46/193 |

FOREIGN PATENT DOCUMENTS

| | | | |
|---|---|---|---|
| 578539 | 7/1946 | United Kingdom | 46/193 |

OTHER PUBLICATIONS

The Torpedo, Latin Percussion, Inc., Jan. 7, 1975.
Rogers Drums Catalog, 64R, p. 82.

*Primary Examiner*—Lawrence R. Franklin
*Attorney, Agent, or Firm*—William J. Smith

[57] ABSTRACT

A musical instrument or other similar article comprised of a generally tubular, hollow casing having a reduced geometry at one end thereof and being filled with popcorn kernels or other sound generating kernels, pellets or the like that generates musical or other tones when shaked by the user.

4 Claims, 2 Drawing Figures

MUSICAL SHAKER

BACKGROUND OF THE INVENTION

The present invention relates generally to the field of musical instruments and noise making toys or devices and more specifically to the type of musical instruments known as maracas.

The maraca is frequently used in the rhythm section of orchestras or other musical groups and is used to establish rhythm in musical performances of all kinds. The maraca as is well known is comprised of a generally spherical dried and hollowed gourd or the like encasing dried seeds or other pellets that produces a "rattle" type percussion sound when it is shaked. The user holds the maraca by a long, narrow stem that is attached by various means to the body of the maraca casing.

Due to the fact that the casing of the maraca is regularly shaped, the tone of the "rattle" sound created by shaking it is invariable. The spherical shape additionally makes it difficult to store and carry the instrument. Additionally, the frequently used natural casing materials are extremely frangible, requiring the user to exercise great care in handling a maraca. The manufacture of a maraca is also relatively time consuming and cumbersome.

SUMMARY OF THE INVENTION

The present invention relates generally to musical percussion instruments of the "rattle" type that are held in the hand of the user and shaken to produce a musical tone or series of musical tones and particularly to such an instrument for generating tones or series of tones associated with the rhythm portion of musical instrumentation. The tones generated by the device constructed in accordance with the preferred embodiment of the present invention are useful in encouraging people to dance and for creating and establishing a rhythm for dancing, as an aid in instructing dancing, as an accompanyment during dancing and any other similar musical use. It is also considered within the scope of this invention that the shaker disclosed herein can be embodied as a child's toy, an amusement device or any other similar type sound generating instrument.

Due to its unique design, the shaker constructed in accordance with the present invention requires no mechanical connections in attaching a handle since the device's casing serves as its own handle, fitting substantially entirely within the hand of the user, if desired. It can be easily held while dancing and requires little or no more room than the dancer would otherwise require and is entirely suitable for use in choreographed dance routines.

The shaker disclosed herein is constructed with an irregularly shaped casing having one end smaller than the other. This design permits the user to create and develop relatively wide tonal variation by controlling and choosing which surfaces of the casing to strike the contained pellets against, the sound emanating from the instrument when the pellets strike the interior surface of the small end of the casing being audibly different from that when the large end or the middle of the device is used. Rapid and repeated tonal variations are also achievable by shaking the shaker so that the pellets strike different surfaces within the casing.

The shaker disclosed herein is easily manufacturable by conventional and inexpensive techniques but may be manufactured by any other suitable technique. Since plastic materials of all types may be used, the present invention is sturdy and difficult to damage. Its flat bottom design, moreover, facilitates easy storage, packaging and handling.

OBJECTS OF THE INVENTION

Accordingly, it is the primary object of the present invention to disclose a rattle type musical instrument, toy or similar article that has pitch variability.

It is another object of the present invention to disclose a novel shaker type percussion instrument that has a self contained handle.

A still further object of the present invention is to disclose a musical rattle that can be simply and inexpensively manufactured.

It is an additional object of the present invention to disclose a shaker type instrument that is durable, easy to handle and easy to store.

Other objects, advantages and novel features of the present invention will become apparent when considered in conjunction with the accompanying drawings.

DESCRIPTION OF THE PREFERRED EMBODIMENT

Figure 1:
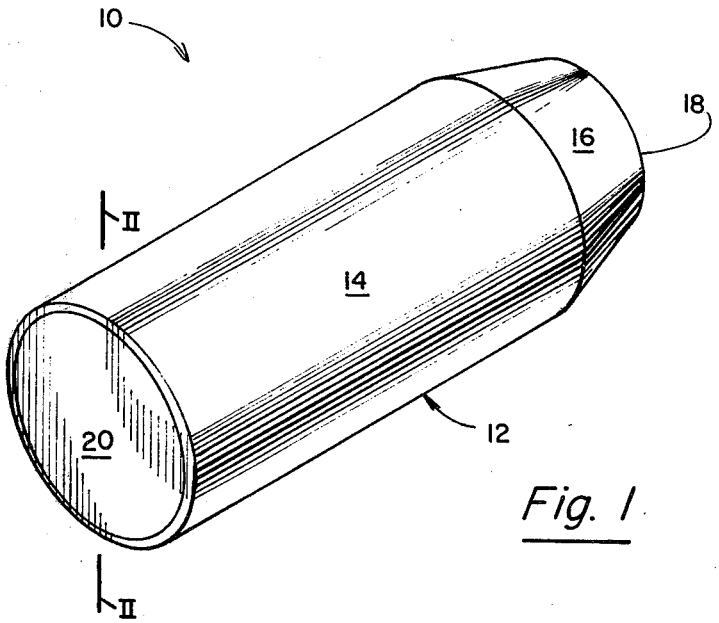
FIG. 1 is an isometric view of the preferred embodiment of the present invention.

Referring now to FIG. 1 there is illustrated an isometric view of the musical shaker 10 of the present invention. The shaker or rattle 10 comprises a casing 12 formed preferably from a hard plastic material such as Lucite or polystyrene although it is to be understood that it is within the scope of this invention to utilize other hard materials such as wood or metal provided that adequate sound levels can be generated therewith. The casing 12 comprises a tubular body member illustrated in the present embodiment as being cylindrical although it is understood that other shapes could also be used such as square, rectangular or triangular tubes.

As oriented in FIG. 1, the shaker 10 has a top section 16 in the shape of a truncated cone that terminates in an end surface 18. As is readily apparent from the drawings, the diameter of end surface 18 is less than the diameter of the body member 14. This truncated conical section 16 serves as a mechanism for enabling variations in the pitch of the sounds generated by the instrument as described above. The other end of the shaker 10 is sealed by a cap or plug member 20, preferably of the same material as the casing 14, that is secured member 20, preferably of the same material as the caing 14, that is secured to the body portion 14 by any suitable means such as glueing. Other techniques could be used to secure the plug 20 to body 14. For example, plug 20 and body 14 could be provided with mating threaded surfaces whereby plug 20 could be screwed into body 14. Other techniques for closing the casing 12 could also be utilized such as press fitting.

Figure 2:
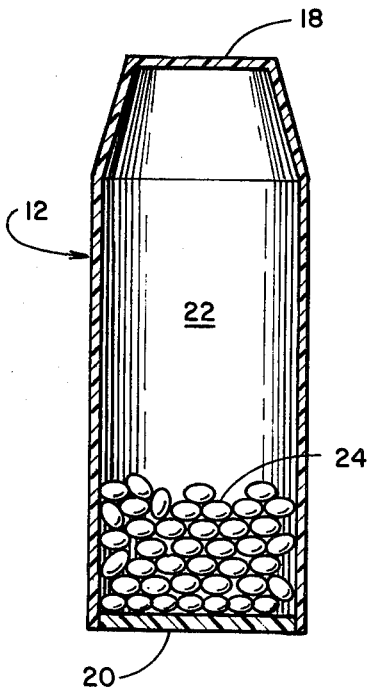
FIG. 2 is a cross section of the instrument illustrated in FIG. 1.

Referring now to the cross section of FIG. 2, it can be seen that the walls of the casing 12 are relatively thin and that the casing, when sealed with plug 20, is a completely, continuous enclosure forming the cavity 22 therewithin. Prior to inserting plug 20, the cavity 22 is partially filled with a plurality of solid objects of pellets 24. In the preferred embodiment, these pellets 24 are comprised of popcorn kernels as it has been discovered that popcorn kernels generate uniquely pleasing musical tones as the instrument 10 is shaked to cause the kernels to strike each other and the interior surfaces of the casing 12. In the preferred embodiment, the kernels 24 occupy approximately ¼ to ⅓ of the volume of the cavity 22 to permit sufficient displacement of the kernels or objects 24 while the instrument 10 is being rattled. It has been discovered that the combination of a hard plastic irregularly shaped casing 12 with the irregularly shaped popcorn kernels permits the device to be constructed small enough to substantially fit within a human hand while still generating levels of sound sufficiently audible to render the device useful and desirable as a musical percussion instrument. Pitch variation is accomplished by controlling which interior surfaces of the casing 12 are struck by the objects 24 during rattling of the shaker 10. The pitch of the sound generated by the instrument varies remarkably when the objects 24 are maintained at the plug 20 end of the instrument 10 as opposed to rattling the instrument 10 with the objects 24 being maintained in the truncated conical section 16. Skillful manipulation of the instrument can result not only in rapid, repetitive tone and tone sequence generation but also in rapid pitch variation.

Exemplary dimensions disclosed to give rise to particularly pleasing tonal quality are as follows although this invention is not limited to these dimensions: casing wall 12 thickness—0.06"; overall length—3.75"; largest diameter of cylindrical body—1.45"; largest diameter of end surface 18—1.0".

While the invention has been described with respect to the presently preferred embodiment which has been found entirely satisfactory, it will be understood by those skilled in the art after understanding the invention, that various changes and modifications may be made without departing from the scope of the appended claims.

What is claimed is:

1. A sound generating device, comprising:

a generally tubular casing having first and second closed ends, said first closed end having a smaller diameter than said second closed end, said casing and said ends being made from a hard plastic material and forming a cavity therewithin; and a plurality of popcorn kernels partially filling said cavity for generating an audible sound upon vibration of said device.

2. The device of claim 1 wherein said casing comprises:

a tubular section; and a truncated conical section having the larger diameter end thereof disposed over said tubular section.

3. The device of claim 1 wherein:

the longest dimension of said device is approximately 3.75 inches;

the diameter of said first end is approximately 1 inch;

the diameter of said second end is approximately 1.45 inches and the wall thickness of said casing is approximately 0.06 inches.

4. In a musical percussion instrument having a continuous hollow casing enclosing a plurality of solid ojects therein for generating a musical tone upon vibration thereof to cause said solid objects to strike each other and/or said casing to generate said tone and having means for holding thereof by a human hand, the improvement comprising:

said casing comprising a generally tubular body closed at one end, the other end being closed by a truncated conical section, whereby varying pitches of said musical tone are produced by varying the surface of said casing which is struck by said objects, said casing being formed of a hard plastic material;

said casing comprising said holding means; and said solid objects being popcorn kernels.

* * * * *